United States Patent [19]

Cornelius et al.

[11] 4,020,198

[45] Apr. 26, 1977

[54] PREVENTING FORMATION OF EXCESSIVE BEAD OF COATING MATERIAL ON METAL CAN RIMS

[75] Inventors: James W. Cornelius; Robert T. Mallon, both of Cincinnati, Ohio

[73] Assignee: Eagle-Picher Industries, Inc., Cincinnati, Ohio

[22] Filed: July 28, 1976

[21] Appl. No.: 709,504

[52] U.S. Cl. ..... 427/336; 118/7; 118/58; 118/324; 118/423; 118/506; 228/19; 427/388 A; 427/424

[51] Int. Cl.[2] ..... B05D 5/00

[58] Field of Search ..... 427/334, 273, 336, 331, 427/333; 228/19, 20, 264; 118/423 T, 73, 506, 425

[56] References Cited

UNITED STATES PATENTS

| | | | |
|---|---|---|---|
| 2,661,310 | 12/1953 | Page et al. | 427/335 X |
| 2,821,491 | 1/1958 | Fleming | 427/336 X |
| 2,841,972 | 7/1958 | Weglin | 427/273 |
| 3,210,182 | 10/1965 | Funari | 228/19 X |
| 3,311,495 | 3/1967 | Snider et al. | 427/331 |
| 3,704,165 | 11/1972 | McLain et al. | 427/334 X |
| 3,713,876 | 1/1973 | Lavric | 228/19 X |

*Primary Examiner*—Morris Kaplan
*Attorney, Agent, or Firm*—Wood, Herron & Evans

[57] ABSTRACT

In the flow coating of inverted metal cans, an unhardened bead of excess coating material at the lower edge of the can is removed in a thinner bath through which the can is passed while hanging suspended from a conveyor. The thinner dissolves the bead and removes the coating on the lower edge of the can. The conveyor lifts the can out of the pool on a gradually rising path with the can hanging essentially vertical. Unhardened coating on the can sidewall above the area from which it has been removed, flows down and recoats the lower edge essentially uniformly but not to excessive thickness.

5 Claims, 8 Drawing Figures

PREVENTING FORMATION OF EXCESSIVE BEAD OF COATING MATERIAL ON METAL CAN RIMS

FIELD OF THE INVENTION

This invention relates to the application of protective surface coatings to metal cans, and more particularly to a method for preventing a free-flowing, hardenable coating from forming an excessively thick bead at the lower edge of the can.

BACKGROUND OF THE INVENTION

It is common practice in the manufacture of metal cans, such as those used as containers for foods and beverages, to apply a protective coating to the cans. The provision of such a coating is especially important in the case of non-alcoholic carbonated beverages, to avoid attack by the contents. Where the cans are of the closed end ("two piece" or integral bottom) type, the protective coating is usually applied as a wash or flow coat to the can interior, exterior, or both, as the can stands inverted on a so-called coating conveyor. For coating the can interior, a spray nozzle projects the coating material up through the open mesh or flat wire network of the conveyor. The large excess of coating material drains off the can walls, through the coating conveyor.

The commonly used coating materials are free-flowing, hardenable resin-containing liquids. They are usually water based; that is, they are at least water dispersible and are generally water soluble. Because of their flowability, low solids content (which may be in the range of about 5–25 weight %), and the fact that the can surface is flooded with an excess of the coating material, the coating material runs downwardly on the can wall toward the lower edge of the inverted can. The film which remains on most of the sidewall is of acceptably uniform thickness, but at the lower edge the coating tends to collect to excessive thickness. This "bead" will not necessarily level out or drain off of its own accord, and unless special efforts are made to remove it, the bead after hardening will be present as an undesirable defect.

The can coating is commonly hardened by heating, for example by passing the can through a continuous oven wherein it is baked at an air temperature of about 425°–475° F. A hardened bead of excessive thickness remaining on the can may crack off, thereby leaving the underlying metal unprotected; moreover, the thick bead material may accumulate on and interfere with the flanging or lid applying machinery.

Modern can making and coating machines operate at extremely high rates, for example, machines producing 800 cans per minute on a 6 foot wide belt are common. These high rates of production, with large total quantities of coatings involved, and the importance of consistently achieving full but not excessive coatings, have presented a need for an effective method of preventing formation of excessively thick beads. It has been the objective of this invention to satisfy that need.

The Prior Art

Methods proposed by the prior art for preventing excessive coating accumulation at the lower edge of coated articles include centrifugal removal by spinning the article after coating to effect uniform distribution, as in Winkler Pat. No. 1,978,121 and Johnson Pat. No. 3,146,873.

In Gladfelter Pat. No. 2,295,575, the ends of inverted cans are slid along an elongated fabric sheet over a support of special cross-sectional shape corresponding to the can edge shape. The drop of excess material is removed by capillary attraction and wiping.

In Page Pat. No. 2,661,310, suspended, dip-coated articles are passed through a chamber in which the viscosity of the paint on the articles is reduced so as to accelerate dripping. This is done by heating and adding a thinner vapor to the current of air in the chamber.

According to Fleming Pat. No. 2,821,491 a bead of waterbased coating is wiped off as the object is slid over rollers wet with water as a solvent for the coating.

In Snider Pat. No. 3,311,495, excess hot dip aluminum coating is removed by contacting the aluminum, while still liquid, with a film of hot liquid aluminum on a separate steel surface to draw off the excess aluminum by surface tension.

In Lavric Pat. No. 3,713,878, solder icicles dripping from coated leads are passed over a heated bath immediately after coating in such proximity that as the icicles form their lowermost portions extend to the bath, are heated by it, and thereby remain in flowable state so that excess solder is drawn off by attraction into the bath.

Beyer et al, Pat. No. 3,952,698 shows apparatus for removing coatings from the lower edge of drawn and ironed metal cans, wherein after coating the cans are moved across a dead plate having openings in it which act as scrapers to remove and wipe off the excess coating material from the open-mouth can edges. The dead plate is vibrated by a bin agitator.

SUMMARY OF THE INVENTION

In accordance with this invention, a method is provided for removing the coating bead during transfer of the can from the coating belt, on which the can is flow coated, to the oven belt which is to carry the can into the curing or hardening oven. An overhead transfer conveyor has can lifting and holding means associated with it for drawing or lifting the inverted can off the coating conveyor and holding it suspended. The lifting and holding means may operate magnetically, for use with steel base cans, or they may be vacuum operated. The conveying run of the transfer conveyor hangs between the end rolls, and carries the can into, through and out of a pool to be described. After treatment in the pool, the can is released from the holding means over the oven belt, which thereafter carries the can into the oven.

An open tank containing a pool of liquid which is a thinner, and preferably a solvent, for the particular coating material employed is positioned below the transfer conveyor and between the end rolls of the coating and transfer belts. The curvature of the hanging transfer conveyor is such that the lower edge of the can enters the pool preferably in an almost horizontal path of motion. The can edge is immersed in the pool to a depth of about 1/16 – ⅛ inch. At the point of deepest immersion in the pool, the can preferably is essentially vertical. The can is carried through the pool a sufficient distance that the thinning or dissolving action of the pool dissolves or otherwise disperses the bead and film of coating from the lower edge. As the conveyor moves on its rising path, the can is carried gradually out of the pool with the can in vertical, or nearly vertical, orientation. Unhardened coating above the transitorily cleaned lower edge flows downwardly. This recoats the lower edge with a film of the coating material which is not of excess thickness. The can is released from the transfer conveyor and is carried into the oven where the film is hardened before so much reflow has occurred that another bead of undesired thickness has formed.

DETAILED DESCRIPTION OF THE INVENTION

The method of the invention can best be further described by reference to the accompanying drawings, in which, FIGS. 1, 2, 3 and 4 are a sequence of diagrammatic illustrations of the mechanism of bead formation, removal, and recoating;

Figure 1:
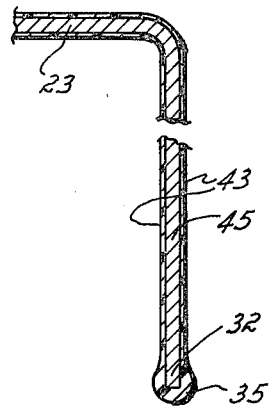

As previously suggested, the invention is especially useful in connection with high speed continuous can coating machines, and for that reason it is illustrated in the drawing in the environment of such a machine. In the coating machine, the containers are passed through a washing device, which may for example be of the type shown in U.S. Pat. No. 3,262,460 or 3,442,708 and including a series of successive wash, rinse, blow-off and drying stations for removing residual oils, grease, and drawing compounds from the cans. Depending on the can material and use, acid or alkaline phosphates and deionized water can be used to prepare the surface for coating, as is well known. The coating itself may be applied as a wash coating, using low pressure spray devices of the same type as shown in the two patents just identified. Most of the excess material drains back into a reservoir and can be reused. The coating material may for example be a low molecular weight water based polymer, possessing hydrophylic groups. Examples of such coatings include an acrylic type water-based coating produced by Celanese Chemical Company, Louisville, Kentucky, under their designation X-1431-B; and an epoxy type water-based coating produced by Dexter Midland Corporation of Waukeegan, Illinois, under their designation LA 67-3. The polymer content by weight in each of the coatings is approximately 20%. The average molecular weight of the coatings is in the range of about 200 to about 30,000, and each coating is suitably water soluble or at least water dispersible.

Figure 5:
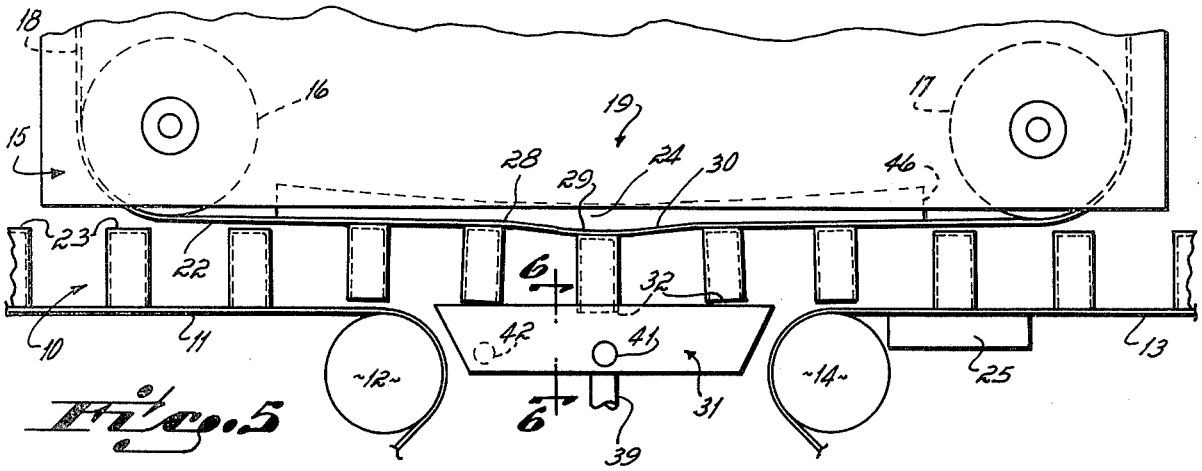
FIG. 5 is a side elevation of a preferred form of apparatus in accordance with the invention, with a magnetically operated transfer conveyor.

Referring first to FIG. 5 of the drawings, a line of cans 10 is shown moving to the right on a coating belt or conveyor 11, toward the conveyor end roll 12. Belt 11 is of the open mesh or flat wire type, known per se in the art. The cans 10 have previously been coated at a spray or flow coating station not shown, as previously referred to, which may be of known type. The cans 10 are coated either on the inside and/or outside surfaces with coating material which has not yet been hardened, which is to be hardened or cured in an oven, not shown, into which the cans will be carried by an oven belt or conveyor 13.

As the just-coated inverted cans stand on the coating belt 11, the thin or freely-flowable coating material runs downwardly and starts to accumulate or bead on the lower edges 32 of the cans.

The upstream end roll 14 of the oven belt 13 is spaced downstream from end roll 12 of the coating belt, in the direction of can travel. An overhead (above the cans) transfer conveyor, generally at 15, conveys the cans from the coating belt to the oven belt. The transfer conveyor has end rolls 16 and 17 and a belt 18 which may be but is not necessarily of the same type as belts 11 and 13. The conveying run 22 of belt 18 hangs below end rolls 16, 17.

At end roll 16 transfer belt 18 passes slightly above the inverted bottoms 23 of the cans, which are resting on the coating belt 11. In order to lift the cans from the coating belt to the transfer conveyor, and to hold them to the transfer belt so that they thereafter move with it, can lifting and holding means generally at 19 are associated with the transfer conveyor 15. These means 19 act through the conveying run 22 of belt 18.

As previously suggested, the lifting and holding means 19 may be magnetic for lifting steel-based cans, or it may be vacuum operated means for use with either aluminum cans (nonmagnetic) or steel cans.

In the magnetic can lifting and holding means 19 in FIG. 5, the belt 18 is made of a non-ferromagnetic material, for example, stainless steel, or alternatively it can comprise a sheet of rubber or the like. On the upper side of the conveying run 22 of belt 18, that is on the opposite side of the belt 18 from the cans, is a fixed shoe generally at 24, which in this embodiment contains an assembly of permanent or electromagnets and pole pieces that provide the magnetic force for lifting the cans from the belt 11 and holding the cans suspended on belt 18. Belt 18 slides past to the shoe, which may be faced with a low frictional surface to facilitate the belt movement past it. As will be explained, the shoe 24 terminates short of end roll 17, so that the magnetic force on the cans terminates as the cans move past the end of the shoe. The cans then drop by gravity, or by opposite magnetic attraction to a shoe containing magnet 25 disposed beneath the oven belt 13. During the two transfers, from the coating belt to the transfer belt and from the transfer belt to the oven belt, the cans remain inverted.

Magnetic conveyors are known per se, and except as described hereinafter, the transfer conveyor 15 may be of known construction, as for example shown in Faller Pat. No. 3,190,298, or in Spodig Pat. No. 3,581,873.

In the conventional overhead transfer conveyor, whether magnetic or vacuum, the conveying run 22 carries the cans directly from the coating belt to the oven belt. In accordance with this invention, the belt 18 is sagged to follow a curved path by which the can lower edge is carried through the thinner pool to be described. This curve may be a catenary curve, but preferably includes a somewhat sharper radius at the center, as will be described. The hinderside of the shoe is itself downwardly curved (rather than being essentially flat, as in the past), and may be shaped to provide a sharper radius of curvature at the center.

The cans 10, once lifted off the coating belt and held to the transfer belt, move along a downward path as at 28, across a dip center 29, then along an upward path 30. By this path of travel, the lower edges 32 of the cans 10 are caused to be immersed in a pool of thinner in an open tank 31, as will now be explained.

Figure 6:
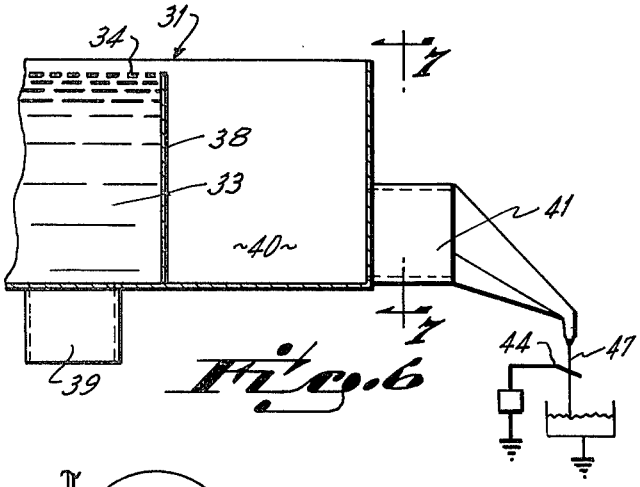
FIG. 6 is an enlarged partial vertical cross section taken on lines 6—6 of FIG. 5, showing the dam, spillway and overflow tank of the thinner pool, and the electrodes for monitoring the overflow of thinner from the pool.
Figure 7:
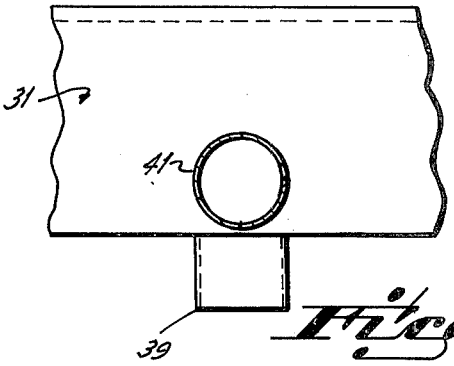
FIG. 7 is a vertical section taken on lines 7—7 of FIG. 6.

Tank 31 is disposed between the adjacent end rolls 12 and 14 beneath the transfer conveyor, and bottom, side and end walls as indicated in FIGS. 5 and 6. The tank is filled with a pool 33 of thinner for the coating material; since the commonly used coating materials are water based, in the preferred embodiment this thinner comprises water. Tap water can be used in localities where it does not contain a high mineral content which would adversely affect its thinning action or leave a residue. Alternatively, deionized water can be used. The pool 33 has a top surface 34 positioned so that at the dip center, the lower edges 32 of the cans, on which the bead 35 is forming, will be slightly below the surface 34. The depth of immersion will of course depend upon the size of the bead that is forming in the particular instance; an immersion depth of about 1/16 – ⅛ inch is sufficient for many purposes. Means may be provided for vertical adjustment of the tank position in relation to the path of can movement, to accommodate cans of different sizes.

The level of the surface 34 in the tank is defined by a spillway at the top of a dam or weir 38 running across the tank. Thinner is added to the pool 33 through an inlet pipe at 42; excess thinner spills over the top of the dam or weir 38 into an overflow chamber 40, to a drain line 41. By reason of the movement of the cans through the pool, the pool is not quiescent and some thinner will flow over the dam in normal use. A separate drain line 39 may be provided to drain the pool upstream of dam 38.

To insure a constant dip level, it is desirable that thinner be constantly added to the pool through inlet line 42. Should filling stop, the pool level would gradually decrease, which could lead to inadequate bead removal. We have found that constancy of thinner level can conveniently be monitored by observing the overflow through drain line 41: so long as thinner is overflowing, the level 34 of the pool 33 will be constant. As shown in FIG. 6, an electrode 44 is mounted to project into a falling stream 47 of overflow liquid coming from drain line 41. The electrode is connected to appropriate circuitry, not shown, and which may be conventional, so as to respond to the flow of current between the electrode and ground, through the falling stream of thinner from the drain line. If the overflow stops, the conduction path stops, and this is reflected as a warning signal so that flow into the tank, and overflow out of it, can be maintained.

Referring again to FIG. 5, it can be seen that because of the angulation of the downward and upward portions 28 and 30 of belt and can travel, the can lower edge enters, passes through, and leaves the bath vertically or at no more than a slight angle to vertical, typically not more than 20°. This near verticality is important, especially as the can leaves the bath, so that the coating will be removed in an essentially uniform band around the can so that reflow will be uniform and will not run to a low point on the can, there to form another excessive bead. Although the cans are closed-end cans, the depth of immersion is not great and the air inside the cans does not prevent the bath from removing interior coating on the inside of the lower edge, if present there.

The cans should be immersed in the pool of thinner for a period sufficient that the thinner can dissolve or disperse the accumulated bead. While this period may, of course, depend upon the nature of the specific thinner and coating, for the conventional water base coatings this occurs quite rapidly. For example, in a machine operating at a rate of 800 cans per minute on a six foot wide belt, the transfer conveyor may move at a rate of about 8 feet per minute, and a dip period of about 2 to 10 seconds, in a water pool 18 inches long, is sufficient.

FIGS. 1–4 show the sequence of bead formation, removal, and coating reflow. In FIG. 1 the bead 35 has been formed by gravity flow of unsolidified coating material to the lower edge 32. If hardened, as it would be by the oven treatment to follow unless the bead is first removed, this bead would interfere with the subsequent flanging operation and/or might crack or flake off, thereby exposing the untreated metal surface to corrosion.

Figure 2:
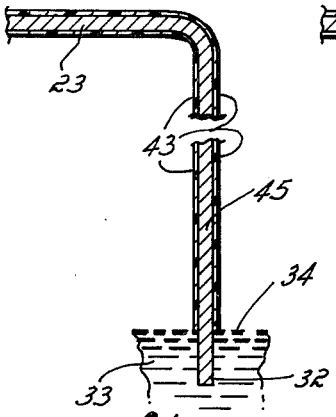

FIG. 2 illustrated diagrammatically the removal of the bead, in effect the removal of all the coating material on the lower edge, during immersion below the pool surface 34. In this figure it can be seen that the film or layer 43 of coating on the can sidewall 45 above the pool surface remains, but the coating has been removed below the surface level. If the can is not vertical or essentially vertical, the depth of immersion will vary around the edge, and the band from which the coating is removed may not be uniform.

Figure 3:
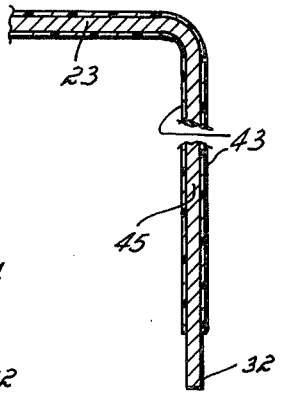

FIG. 3 illustrates a transitory condition which exists just as the can is removed from the pool. The can lower edge 32 is briefly essentially clear of coating material. A film of water may adhere to the lower end 32 of the can during this moment however if no reflow occurred and the water film were dried, its evaporation would leave no solids or protective coating on the lower edge, and that portion of the can would be deficient.

Figure 4:
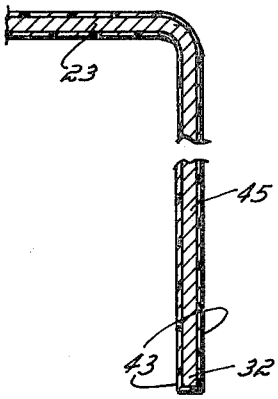

That undesirable condition is corrected by reflow or recoating, as illustrated in FIG. 4. This occurs by further drainage of unhardened coating material from the film 43 above the lower edge, down over the lower edge, so that the latter is effectively recoated. For this to occur properly however the can must be essentially vertical, in order to insure that as the can moves on the upward path 30, the coating does not reflow excessively to the lowest side of the can. The reflow must occur before the coating is hardened in the oven, which of course would terminate further flow and prevent recoating. In the preferred embodiment the maximum angulation of the can is only about 20° from vertical.

Returning to FIG. 5, after leaving the pool 33 the cans are carried above end roll 14 of the oven belt. At the end 46 of the shoe, the lifting force which holds the cans to the transfer belt is released, and the cans drop onto oven belt 13. Alternatively and/or additionally, a magnet shoe 25 may be provided beneath the oven belt 13 to insure proper can positioning on that conveyor. Belt 13 carries the cans to an oven, which may be conventional, for hardening the coating.

Figure 8:
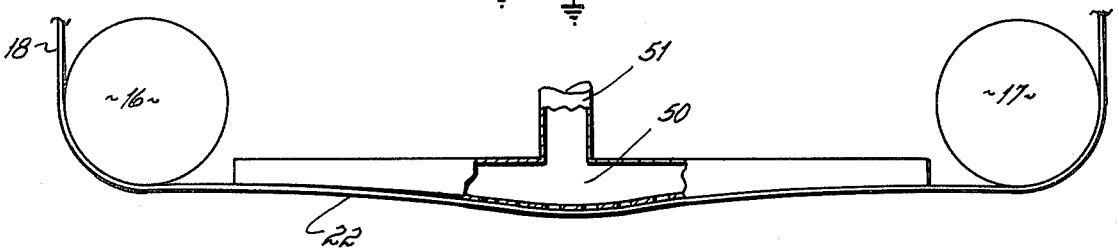
FIG. 8 is a diagrammatic view of a modified embodiment of can holding and lifting means for use in the invention, in which the cans are held to the transfer conveyor by vacuum rather than by magnetic action.

As suggested above, the can lifting and holding means 9 can alternatively be a vacuum holding means. This is illustrated in FIG. 8. Such vacuum can-holding means are known per se and do not themselves comprise the invention. In vacuum holding means a chamber 50 connected at 51 to a vacuum source is disposed above the conveying run 22 of the transfer conveyor in place of the magnetic shoe described above. For vacuum conveying the belt 18 has a large plurality of small holes in it through which air is drawn as the belt passes across chamber 50. The belt effectively closes that chamber except for the flow through openings in the belt; rush of air to those openings carries or draws the cans to the belt and the pressure differential then holds the cans to the belt. Chamber 50 has a curvature such as has already been described, to achieve the desired passage of the cans into, through and out of the bath.

By thus utilizing a thinner bath to remove the bead and then permitting unhardened material to flow down and recoat the stripped surface, this invention provides an improvement over prior art techniques of bead removal based on absorption, wiping, or drawing off by surface tension forces. Where the can edge presents a burr, as frequently occurs, coating material will sometimes remain lodged behind or above the burr, where it is not removed by absorption or wiping or contact with coating material. The physical immersion, dissolution or dispersing method provided by this invention clears beads even behind burr edges, and thereby provides a better result.

Having described the invention, what is claimed is:

1. In a process for applying a surface coating to a can wherein a free-flowing hardenable coating material is applied to an inverted metal can and thereafter drains downwardly toward the lower edge of the can and tends to form a bead thereon, the method of eliminating an excessively thick bead of the coating material on the lower edge of said can, said method comprising, holding the can so that it hangs suspended while said material is collecting at said edge to form a bead, before the bead has hardened, moving the can thus suspended along a path such that only the lower edge of the can, at which the bead is forming, is dipped below the surface of a bath containing a pool of thinner for the coating material, for a period of time sufficient that the thinner substantially removes the unhardened bead of coating material, removing the can from the bath, maintaining the can in inverted position until unhardened coating material remaining on the can above said edge drains onto said edge and recoats the same but not excessively, and then hardening said coating material.

2. The method of claim 1 wherein said coating material is water based and said thinner is water.

3. The method of claim 1 wherein said coating material is water soluble and said thinner is water.

4. The method of claim 1 wherein said coating is hardened by baking.

5. The method of claim 1 wherein said coating material is applied as a spray to the inverted can while the can is resting on a meshwork belt, said can is transferred from said belt to an overhead conveyor, from which it hangs suspended during said dipping, and following said dipping said can is transferred from the overhead conveyor to another conveyor for the hardening step.

* * * * *